US011629543B2

(12) United States Patent
Sicot

(10) Patent No.: US 11,629,543 B2
(45) Date of Patent: Apr. 18, 2023

(54) BUFFER HAVING A SELF-ADJUSTABLE STOPPER

(71) Applicant: A. RAYMOND ET CIE, Grenoble (FR)

(72) Inventor: Mikael Sicot, Varces Allieres et Risset (FR)

(73) Assignee: A. RAYMOND ET CIE

( * ) Notice: Subject to any disclaimer, the term of this patent is extended or adjusted under 35 U.S.C. 154(b) by 171 days.

(21) Appl. No.: 16/998,173

(22) Filed: Aug. 20, 2020

(65) Prior Publication Data

US 2021/0131158 A1 May 6, 2021

(30) Foreign Application Priority Data

Aug. 29, 2019 (FR) ..... 1909494

(51) Int. Cl.
*E05F 5/02* (2006.01)
*E05F 7/04* (2006.01)
*E05F 5/06* (2006.01)

(52) U.S. Cl.
CPC ..... *E05F 5/025* (2013.01); *E05F 5/022* (2013.01); *E05F 5/06* (2013.01); *E05F 7/04* (2013.01); *E05Y 2900/531* (2013.01)

(58) Field of Classification Search
CPC ... E05F 7/04; E05F 5/025; E05F 5/022; E05F 5/02; E05F 5/06
USPC ..... 296/207
See application file for complete search history.

(56) References Cited

U.S. PATENT DOCUMENTS 1,888,829 A * 11/1932 Moore ..... E05F 7/04 292/16
4,178,658 A * 12/1979 Gergonne ..... E05F 5/06 16/86 A
5,584,528 A * 12/1996 Cozzani ..... E05F 5/022 248/548
5,937,585 A * 8/1999 Tidbury ..... E05F 7/04 49/504
7,014,258 B2 * 3/2006 Schubring ..... B60J 5/10 292/216
7,121,616 B2 * 10/2006 Cooley ..... E05F 7/04 296/207

(Continued)

FOREIGN PATENT DOCUMENTS

FR 2885640 11/2006
GB 2410990 8/2005

*Primary Examiner* — Jeffrey O'Brien
(74) *Attorney, Agent, or Firm* — Perman & Green, LLP

(57) ABSTRACT

A buffer with a self-adjustable stopper including a buffer head, a base having a guide profile, and a central body having a groove cooperating with the profile, the central body being mounted on the base by a translation movement, in a first direction (X) in a plane of movement, the central body at least partially receiving the buffer head. The buffer head includes a locking member inserted into the central body in a second direction (Y) and blocks in a third direction (Z) the buffer head in the central body and blocking in the first direction the central body on the base. The locking element and the buffer head include, respectively, at least one thrust ramp and at least one housing adapted to receive said at least one ramp adapted to, when the locking member is translationally actuated, produce a camming effect and to allow raising of the buffer head.

16 Claims, 4 Drawing Sheets

(56) References Cited

U.S. PATENT DOCUMENTS

| | | | | |
|---|---|---|---|---|
| 8,322,762 | B2 * | 12/2012 | Watson | E05F 7/005 292/342 |
| 8,888,170 | B2 * | 11/2014 | McCuller | E05F 5/022 296/193.11 |
| 10,450,785 | B2 * | 10/2019 | Osti | E05B 77/38 |
| 10,836,238 | B2 * | 11/2020 | Thurgate | B62D 65/024 |
| 10,836,239 | B2 * | 11/2020 | Thurgate | B60J 5/107 |
| 11,162,290 | B2 * | 11/2021 | Favero | E05B 83/24 |
| 11,280,123 | B2 * | 3/2022 | Zirek | E05F 5/08 |
| 11,421,462 | B2 * | 8/2022 | Gardynik | E05F 5/022 |
| 2006/0097550 | A1 * | 5/2006 | Wang | E05F 5/022 296/207 |
| 2006/0244286 | A1 * | 11/2006 | Meyers | E05F 7/04 296/146.1 |
| 2010/0219648 | A1 * | 9/2010 | Watson | E05F 7/04 292/343 |
| 2014/0338167 | A1 * | 11/2014 | Jackson, Jr. | B60J 5/101 29/418 |
| 2020/0157869 | A1 * | 5/2020 | Song | E05B 85/045 |

* cited by examiner

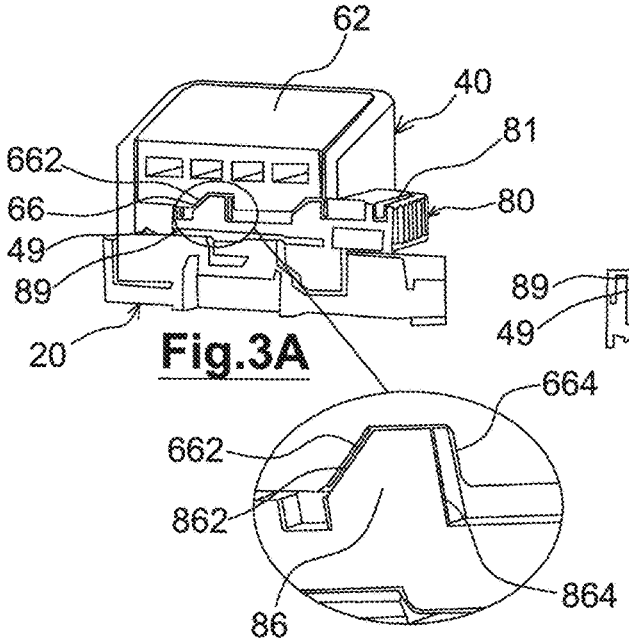
Fig.3A
Fig.3C
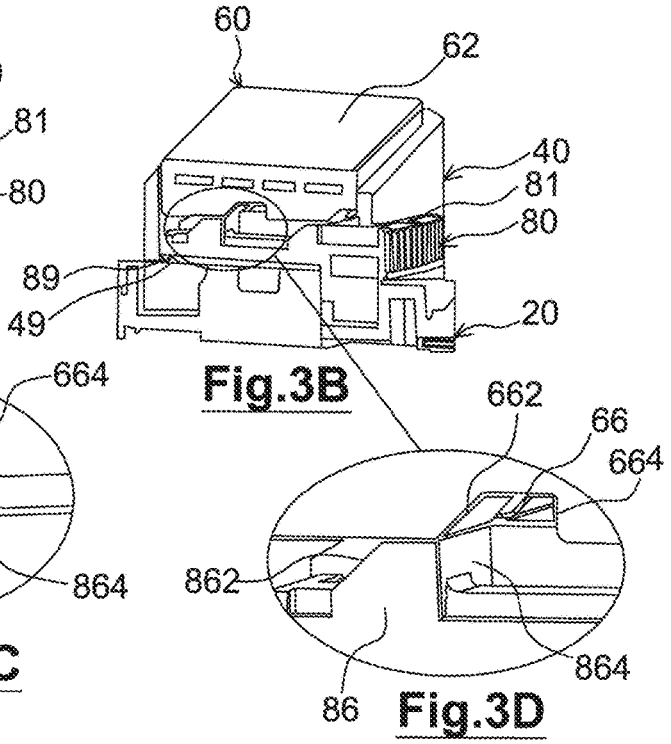
Fig.3B
Fig.3D
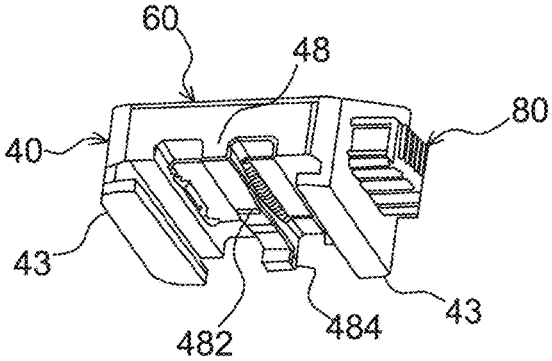
Fig.4A
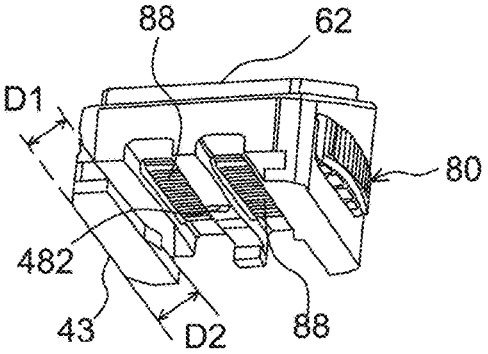
Fig.4B
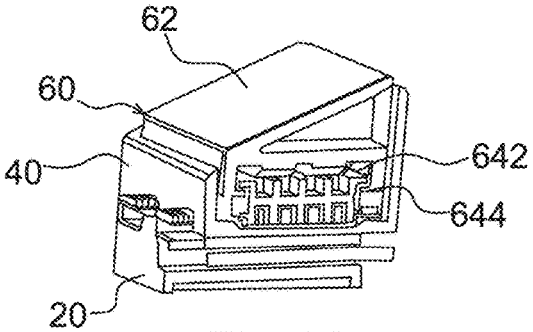
Fig.6A
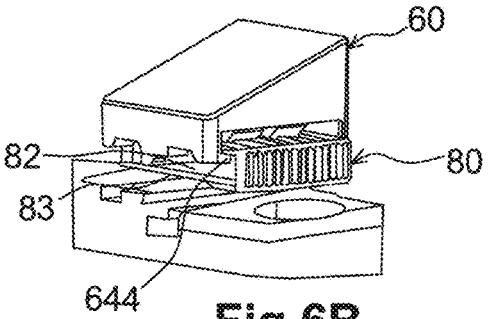
Fig.6B

BUFFER HAVING A SELF-ADJUSTABLE STOPPER

CROSS-REFERENCE TO RELATED APPLICATION

This application claims priority to and the benefit of French Application No. FR1909494, filed on 29 Aug. 2019, the disclosure of which is incorporated herein by reference in its entirety.

BACKGROUND

1. Field

The present disclosure belongs to the field of vehicle equipment, particularly closing buffers, and relates more particularly to a buffer with a self-adjustable stopper intended to hold a first pivoting structure on a second fixed structure such as a motor vehicle chassis. For example, the first pivoting structure may be a side door, a rear door, or a hood, or indeed a single/double-swing door of a utility vehicle.

2. Brief Description of Related Developments

A buffer with a stopper for closing a rear door typically comprises a stopper fastened to the vehicle body, and a counter-stopper on the rear door, these two elements cooperating to hold the rear door in relation to the body when the rear door is closed. The rear door may be equipped with a plurality of buffers. In order to facilitate the mounting of the buffer particularly in respect of alignment of these two elements, the stopper on the fixed structure is provided with a surface serving as an adjustable stopper. This type of device is known from the prior art.

The British patent GB2410990 describes a buffer with a stopper including a main body, a sliding element in the main body, and a lock. For the mounting thereof, the main body and the sliding element are fastened in a first phase to the body. The position of the sliding element is set by the closure of the moveable structure. The locking element is finally inserted into the sliding element to fix the position of the sliding element in the main body after reopening the moveable structure. The position of the sliding element may be disturbed by different strains such as reopening the moveable structure, introducing the locking element. In particular, the latter is carried out by means of an inclined surface. Once locked, no possibility of readjusting the device is envisaged.

SUMMARY

The aim of the present disclosure is that of remedying these drawbacks, by proposing a buffer with a self-adjustable stopper which enables a simple assembly and a rapid mounting in a given structure.

For this purpose, the present disclosure relates to a buffer, or buffer, with a self-adjustable stopper, comprising a buffer head having an upper surface as a stopper, a base including a guide profile, and comprising a central body including a groove cooperating with said profile, the central body being mounted on the base by a translation movement, in a first direction in a plane of movement, the central body partially receiving the buffer head by a face opposite to that in contact with the base, the buffer head being moveable relative to the central body in a third direction substantially perpendicular to the plane of movement, the buffer further comprising a locking member inserted into the central body, in a second direction substantially perpendicular to the first direction and the third direction, and operable in translation for blocking in the third direction the buffer head in the central body and blocking in the first direction the central body on the base.

According to a first aspect of the disclosure, the buffer with a self-adjustable stopper has the following features:

- the locking element and the buffer head include, respectively, at least one thrust ramp and at least one housing adapted to receive said at least one ramp, said at least one thrust ramp and said at least one housing being adapted, when the locking member is translationally actuated, to produce a camming effect and to allow raising of the buffer head;
- the locking element has an open position, in the central body, in which the at least one thrust ramp is received by the at least one housing and the locking element can be depressed in the second direction and a locked position, wherein the buffer head is blocked in the third direction;
- the locking element and the base include locking means which cooperate only in the locked position to block the central body in the first direction.

Advantageously, the buffer makes it possible to reduce noise, particularly when closing a rear door.

Advantageously, the stopper is self-adjustable in order to perform a setting of the buffer when mounting on a structure.

Advantageously, when locking the buffer with a stopper after setting, the raising of the stopper which holds the moveable structure makes it possible to guarantee tension with the moveable structure closed.

Advantageously, the buffer makes it possible to hold the moveable structure closed radially in order to reduce the noise.

Advantageously, the buffer head rises in the central body thanks to slopes located on the locking element.

Advantageously, the buffer head rests on the locking element in the locked position so as to prevent the unlocking of the locking element during strains.

The disclosure is advantageously executed according to the aspects of the disclosure and the alternative aspects disclosed hereinafter, which are to be considered individually or according to any technically effective combination.

In an aspect of the disclosure, the top surface of the buffer head is inclined with respect to the plane formed by the first and the second directions.

In an aspect of the disclosure, the central body is moveable in the first direction, the locking member being in the open position.

In an aspect of the disclosure, the buffer with a stopper further includes means for defining the path of the central body in the first direction.

In an aspect of the disclosure, the buffer with a stopper further includes means for positioning the central body on the base, the locking element being in the open position.

In an aspect of the disclosure, means for positioning said central body on said base include a rack on the base and a belt including a bulge.

In an aspect of the disclosure, said guide profile has a T-shaped section.

In an aspect of the disclosure, the locking means consist of at least one rack on the T-shaped guide profile and a rack of the locking element.

In an aspect of the disclosure, the buffer with a self-adjustable stopper further includes means for holding the buffer head in position in the third direction in the open position, preferentially, the holding means is a rod elastically connected to the locking element, such that it rests on the buffer head.

In an aspect of the disclosure, the central body and the base are assembled by snap-fitting.

In an aspect of the disclosure, the buffer with a self-adjustable stopper further includes means for returning it to the open position.

In an aspect of the disclosure, the buffer with a self-adjustable stopper is not dismountable in the open position.

According to a second aspect, the present disclosure relates to a method of mounting a buffer according to the invention on a first structure to separate it from a second moveable structure. This method includes the following steps:

(i) fixing the self-adjustable stop buffer in the open position on the first structure;
(ii) rotating the second structure to adjust the central body in the first direction with respect to the base;
(iii) reopening the second structure;
(iv) putting the buffer in the locked position by actuating the locking member.

Advantageously, the buffer with a stopper according to the disclosure makes it possible to simplify the process of the mounting thereof between two structures and reduce the mounting time and the number of parts.

BRIEF DESCRIPTION OF THE DRAWINGS

Further advantages, aims and features of the present disclosure emerge from the following description given, for the purpose of explanation and not restriction, with reference to the appended drawings, wherein:

FIG. 3A represents a perspective section of the buffer along the section AA' in FIG. 2A;

FIG. 3B represents a sectional view of the buffer along the section BB' in FIG. 2B;

FIG. 3C represents a detailed view of the thrust ramp and the housing thereof in FIG. 3A;

FIG. 3D represents a detailed view of the thrust ramp and the housing thereof in FIG. 3B;

FIG. 4A represents a bottom view of the assembly of the buffer head, the central body, and the locking element of the buffer with a self-adjustable stopper in the open position in FIG. 2A;

FIG. 4B represents a bottom view of the assembly of the buffer head, the central body, and the locking element of the buffer with a self-adjustable stopper in the locked position in FIG. 2B;

FIG. 6A represents a sectional view of the buffer along the section DD' in FIG. 2B;

FIG. 6B represents a view of the assembly of the buffer head, the central body, and the locking element of the buffer with a self-adjustable stopper in FIG. 2B;

DETAILED DESCRIPTION

The different figures as well as the elements of the same figure are not necessarily represented on the same scale. In all of the figures, identical elements bear the same reference number.

The terminology used in the present description must under no circumstances be interpreted in a limiting or restrictive manner, simply because it is used in conjunction with a detailed description of certain aspects of the disclosure.

Figure 1A:
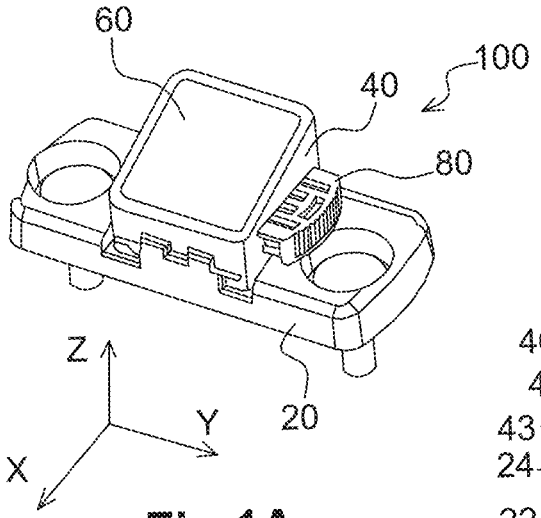
FIG. 1A represents a perspective view of a buffer with a self-adjustable stopper according to the disclosure.

Throughout the description, the terms "top", "bottom", "front", "rear", "upper", "lower", "vertical", "horizontal", as well as the terms and expressions which may be associated therewith or derived therefrom will be understood, unless specified or shown otherwise, as having the meaning that would be given thereto by an operator of the device represented in FIG. 1A. Accounting for the axis system (XYZ) represented in this figure, the front and the top are located respectively along increasing X and increasing Z.

Figure 9:
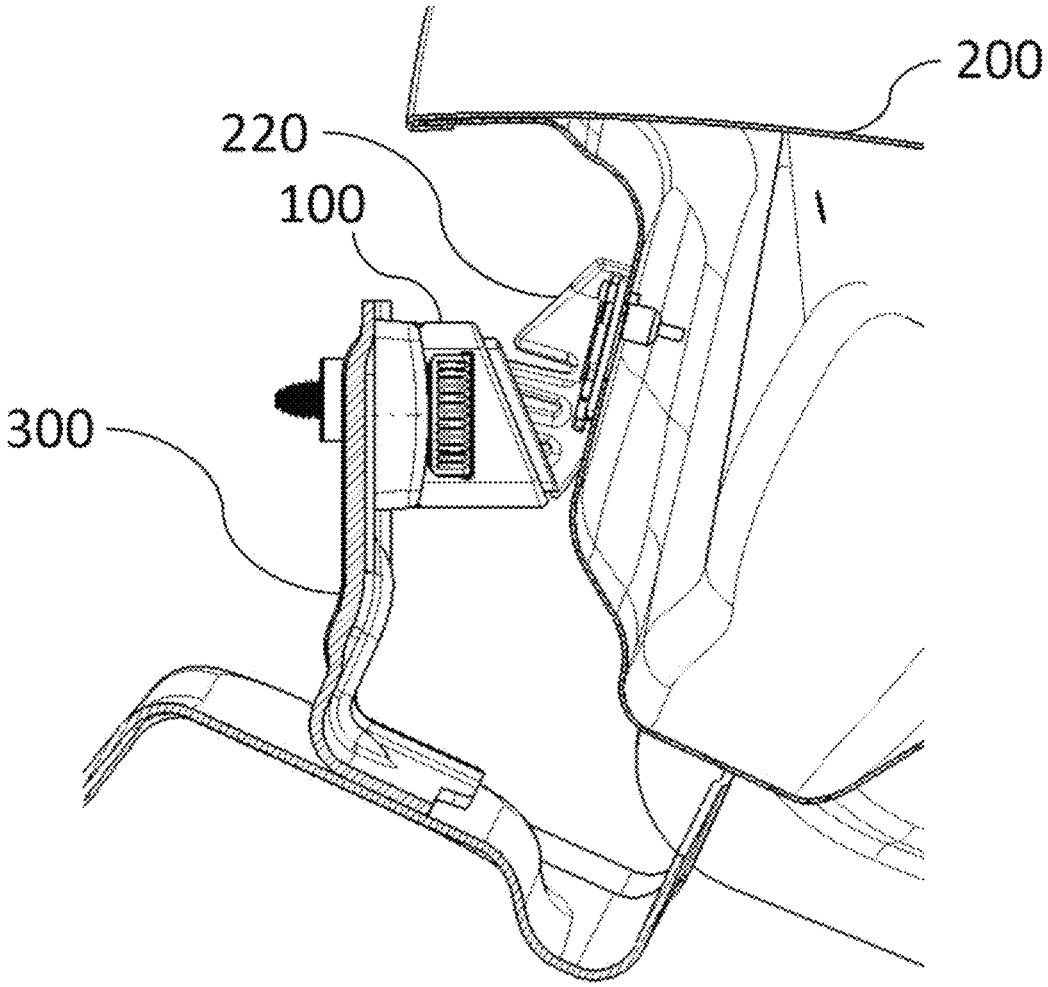
FIG. 9 represents a sectional view of a part of a pivoting structure and a fixed structure with a buffer with a self-adjustable stopper according to the disclosure.

FIG. 9 illustrates a pivoting structure 200, herein a single-double-swing rear door of a utility vehicle, which closes a fixed structure 300 of the vehicle, in this case the fixed part of the rear trunk of the vehicle. A buffer with a self-adjustable stopper 100 is mounted on the fixed trunk part whereas an optional counter-stopper 220 is mounted on the rear door 200. The counter-stopper 220 comes into contact with the buffer head of the device 100 when the rear door is closed.

FIG. 1A shows a diagram of a buffer with a self-adjustable stopper in the open position. In FIG. 1A, the buffer with a self-adjustable stopper 100 according to the disclosure comprises a base 20, a central body 40, a buffer head 60, and a locking element 80.

These four components can be produced by molding known plastic material, more particularly made of technical plastics such as polyamides, acetal resins, thermoplastic polyesters.

Thus, such a buffer with a self-adjustable stopper can be produced at a low cost.

In the present description, "open position" of a buffer with a stopper denotes a position wherein the stopper head is adjustable, the locking element being in the open position; "locked position" of a buffer with a stopper denotes a position wherein the stopper head is locked, the locking element being in the locked position.

The central body 40 receiving the buffer head 60 via the upper part thereof and the locking element 80 via the left face thereof can be assembled, via the lower part thereof, to the base 20, by sliding mounting, for example by means of a rail.

Figure 1B:
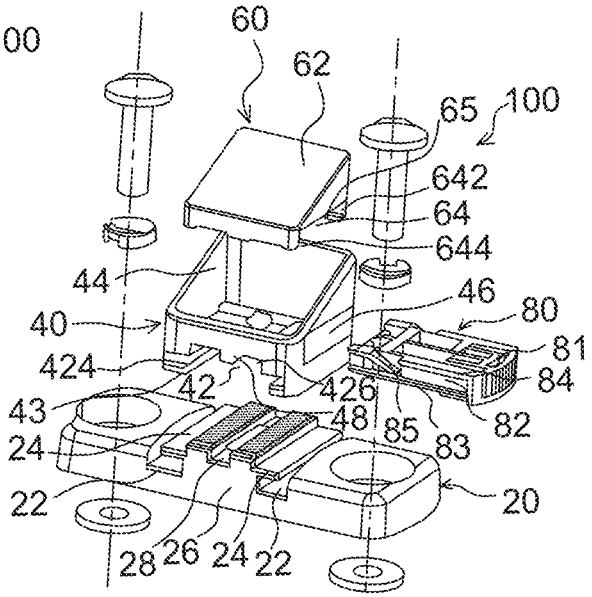
FIG. 1B represents an exploded view of a buffer with a self-adjustable stopper according to the disclosure.

In the aspect of the disclosure in FIG. 1B, the base 20 has two grooves 22 along the axis X of L-shaped section, the bottoms whereof are respectively facing edges 24, thus, a central part 26 formed between the two grooves 22 forms an essentially T-shaped profile including an upper surface 26. On the upper surface 26, the base 20 further includes two straight racks 30 substantially along the axis X and separated by a central strip 28. A straight rack 32 which extends along the axis X, is presented on said central strip 28.

The central body 40 includes in the lower part thereof means adapted to carry out a sliding mounting on the base 20. In an aspect of the disclosure described, the central body 40 includes an essentially T-shaped groove cooperating with said essentially T-shaped profile of the base 20. When the central body 40 is mounted on the base 20, the lower walls 43 thereof can be housed in the L-shaped grooves 22. Advantageously, this arrangement makes it possible to prevent a relative movement between the base 20 and the central body in the direction of the axis Z. The central body 40 further includes two grooves 426 adapted to receive the straight racks 30 of the base 20, said grooves 426 being separated by a belt 48.

In FIG. 1B, the buffer with a self-adjustable stopper 100 includes a buffer head 60 having an upper surface 62 which forms the stopper. In the aspect of the disclosure illustrated, the buffer head 60 has essentially the shape of a triangular block, optionally raised, the triangular cross-section whereof is located in the plane XZ, the surface 62 being inclined from the rear to the front. The buffer head 60 has a recess 64 which includes two straight grooves 642, one facing the other, on the front and rear walls and provides an opening 65 onto the right face of the buffer head 60. The straight rails 642 form rails with which the opening 65 is adapted to receive the locking element 80.

The central body 40 also has a recess with an opening 44 to the top, this recess being adapted to fit at least partially the buffer head 60. The central body 40 has, on the right face thereof, a lateral opening 46 adapted to receive the locking element 80.

On the front and rear walls thereof, the locking element has, along the axis Y, two grooves 82 delimited respectively by lower edges 83 and upper edges 84. The grooves 82 are adapted to receive the lower edges 644 of the grooves 642 when the locking element itself is received by the buffer head.

In the aspect of the disclosure in FIG. 1B, a slot 81 is also provided at the right end of the locking element 80.

Figure 1C:
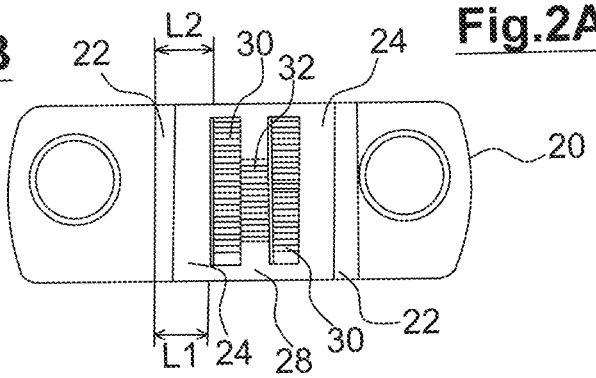
FIG. 1C represents a schematic illustration of a base of a buffer with a self-adjustable stopper according to an aspect of the disclosure.

In FIG. 1C, a base 20 and straight racks 30 and 32 essentially along the direction X on the upper face of the base 20 are observed. Each groove 22 has a width L1 at the level of the front face thereof and a width L2 at the level of the rear face thereof. The edges facing the bottoms of the grooves 22 extend along the axis X.

In an aspect of the disclosure, the buffer assembly according to the disclosure is produced as follows: (a) the central body 40 is first mounted on the base 20 by introducing the central body 40 onto the T-shaped profile forming a rail and sliding it along the axis X; (b) the buffer head 60 is then fitted in the central body 40 ensuring that the lateral openings 65 and 46 thereof are on the same side; (c) finally, the locking element is introduced via the face thereof into the lateral opening 46 and also the opening 65.

Figure 2B:
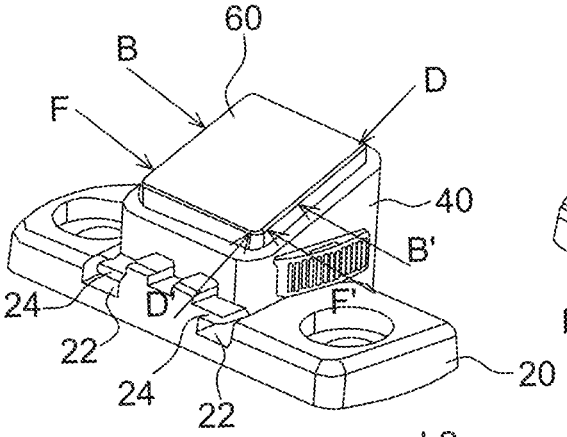
FIG. 2B represents a setting and locking diagram of a buffer with a self-adjustable stopper in the locked position.
Figure 2A:
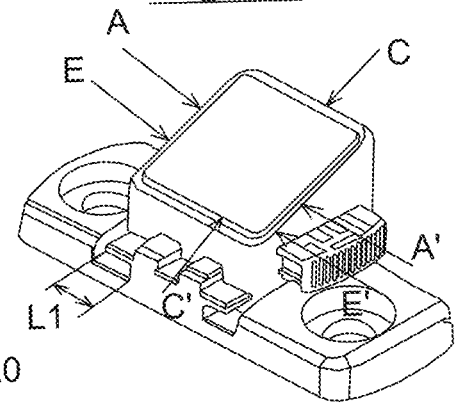
FIG. 2A represents a setting and locking diagram of a buffer with a self-adjustable stopper preassembled and in the open position.

FIGS. 2A and 2B illustrate respectively a buffer with a self-adjustable stopper according to the disclosure in the open position and in the locked position. The buffer with a self-adjustable stopper according to the disclosure is preassembled with the components 20, 40, 60 and 80 thereof as described above. The preassembled buffer, as illustrated in FIG. 2A, is ready to be mounted on a structure such as a vehicle chassis.

FIGS. 3A and 3B illustrate, respectively, a sectional view of the buffer along the section AA' in FIG. 2A where the buffer 100 is in the open position and a sectional view of the buffer along the section BB' in FIG. 2B where the buffer 100 is in the locked position, in the plane YZ.

The locking element 80 includes at least one thrust ramp 86 on the contact face thereof with the buffer head 60 which includes, for its part, at least one housing 66 defining an identical profile to the thrust ramp 86, the housing 66 being adapted to receive the thrust ramp 86 in the open position. The housing 66 and the thrust ramp 86 are arranged such that, in the open position, when the locking element 80 is removed from the central body 40, the thrust ramp 86 is blocked by the housing 66 and when the locking element 40 is depressed toward the central body 40, the thrust ramp 86 comes out of the housing 66.

In the aspect of the disclosure illustrated in FIGS. 3A and 3B, the thrust ramp 86 has, in the plane YZ, a rectangular trapezoid section with the long base thereof at the bottom. The thrust ramp comes out of the housing by means of an inclined surface 862 including the inclined side of the rectangular trapezoid and a cooperating surface 662 of the housing 66, when the locking element is pushed toward the central body 40 by the right end thereof. Simultaneously, the translation movement of the thrust ramp 86 in relation to the buffer head 60 produces, via a camming effect with the cooperating surface 662 of the housing 66, a translation along the axis Z toward the top of the buffer head in the central body 40, inducing a relative raising of the buffer head 60 by a height H in the central body 40. The height H corresponds to the thickness of the thrust ramp along the axis Z.

In an aspect of the disclosure, the assembly of the locking element and the buffer head is clamped in the locked position such that unlocking of the locking element cannot be induced by mere strains, caused for example by the vibration of the chassis wherein the buffer is mounted.

As illustrated in FIGS. 3A and 3B, the locking element 80 includes a bulge 89 and the central body 40 includes a bulge 49. Thanks to the elasticity of the material and the slopes of these bulges 89 and 49, when the locking element 80 moves from the open position to the locked position, the bulges 89 and 49 pass over one another and form an interlock. A further advantage is that of indicating the switch to the locked position of the locking element. This arrangement makes it possible to prevent unlocking by mere strains; on the other hand, the switch from the locked position to the open position is possible with an envisaged uncoupling force.

On the other hand, the housing 66 has a vertical surface 664 serving as a stop which makes it possible to prevent the thrust ramp from coming out of the housing in the opposite direction. The vertical face 864 of the ramp presses on the vertical surface 664, in the knowledge that the buffer head 60 per se is fitted in the central body 40. FIGS. 3C and 3D illustrate, respectively, the cooperation of the ramp 86 and the housing 66 in detail in the open and locked positions.

In an alternative aspect of the disclosure, the cross-section in the plane YZ of the thrust ramp 86 is a right-angled triangle. In a further alternative aspect of the disclosure, the thrust ramp includes a profile which enables several successive raisings of the stopper head.

FIG. 4A illustrates a bottom view of the assembly of the buffer head 60, the locking element 80, and the central body 40 of the buffer in the open position in FIG. 2A; FIG. 4B illustrates a bottom view of the same assembly of the buffer in the locked position in FIG. 2B.

Figure 5:
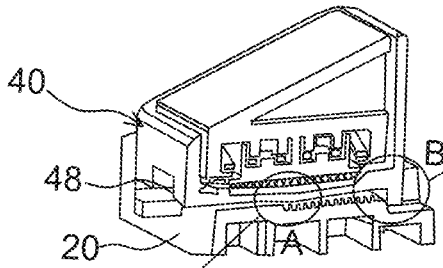
FIG. 5 represents a sectional view of the buffer along the section CC' in FIG. 2A.

In the aspect of the disclosure in FIG. 4A, the belt 48 of the central body 40 includes a blocking device, on a lower face, for example at least one bulge 482 forming a notch which engages with the second rack 32 provided on the base 20 when the central body is mounted thereon. Advantageously, this blocking device makes it possible to position the central body 40 on the base 20 during the translation movement of the central body 40 relative to the latter, as illustrated in FIGS. 5 and 5A which will be detailed hereinafter. Given that the central body 20 can be made of plastic, the belt 48 has a certain elasticity. The bulge 482 therefore does not prevent this relative translation movement. This represents a further advantage of the disclosure which will be detailed hereinafter, particularly during the mounting of the buffer on a chassis.

In an aspect of the disclosure, the central body 40 includes a protruding element 484 toward the bottom serving as a stop, in one end of the belt 48.

It can be observed in FIG. 4B that said at least one rack 88 of the locking element 20 is exposed to the grooves 426 which receive said racks 30 of the base 20. The assembly of the central body, the base, and the locking element are arranged such that the racks 30 and 88 cooperate in the locked position, by blocking the central body 40 in the axis X. More generally, said at least one rack of the locking element can be in the form of gouges or joined channels forming notches.

FIG. 5 illustrates a sectional view of the buffer in the open position along the section CC' in FIG. 3A in the plane XZ, where a system for positioning the central body on the base 20 can be observed. The bulge is presented in the form of a tooth 482 engaging with the rack 30 with projections 32.

Advantageously, this positioning means 482 and 30 makes it possible to hold the central body 40 in position on the base 20 in the axis X without undesired movement, for example, the central body 40 can occupy in a stable manner an initial position after the buffer in the open position has been mounted on a structure, and a second position after setting wherein the buffer is locked by actuating the locking element 80. Advantageously, this positioning means makes it possible to prevent undesirable movements of the central body 40, for example a translation caused by gravitational force or indeed a vibration.

Figure 5B:
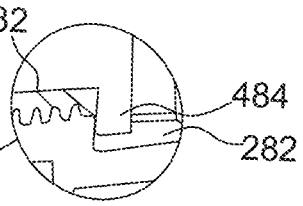
FIG. 5B represents a detailed view of part B in FIG. 5A.
Figure 5A:
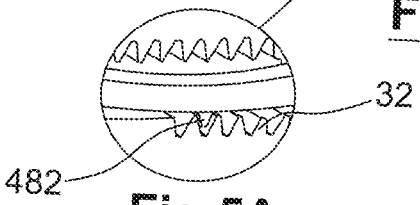
FIG. 5A represents a detailed view of part A in FIG. 5A.

As illustrated in FIGS. 5 and 5B, the protruding element 484 forming a first blocking mechanism rests on the rear face of the base 20, or the central strip 28 thereof which includes, if applicable, a recess 282 adapted to receive the stop 484. In an aspect of the invention, the recess 282 extends along the rack 30 forming a stage. The bulge 482 can therefore not move beyond the position that it occupies on the rack 32 when the stop 484 rests on the base 20, thus defining a first end of the path of the positioning means 482.

FIG. 6A illustrates a sectional view of the buffer along the section DD' in the plane XZ in FIG. 2B. FIG. 6B illustrates a view of the assembly of the locking element, the buffer head, and the central body of the buffer with a stopper in the locked position in FIG. 2B. The locking element 80 includes means intended to retain the buffer head in the axis Z. In an aspect of the invention, the locking element includes at least one groove 82 extending along the axis Y, if applicable, a groove 82 on each of the front and rear faces thereof. When the locking element 80 is introduced into the central body according to the disclosure, the buffer head receives same via the opening 65 thereof with a T-shaped vertical section, the lower edges 644 being received by at least one groove 82. Advantageously, these means make it possible to limit the movement of the buffer head in the axis Z.

Figure 7B:
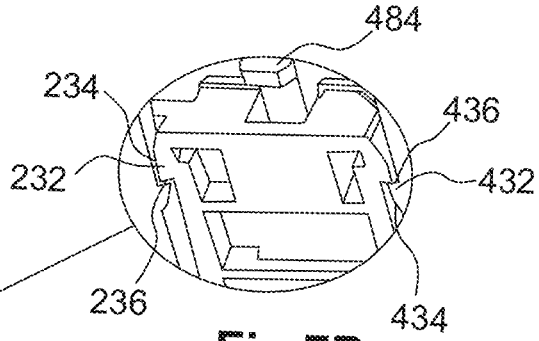
FIG. 7B represents a detailed view in FIG. 7A.
Figure 7A:
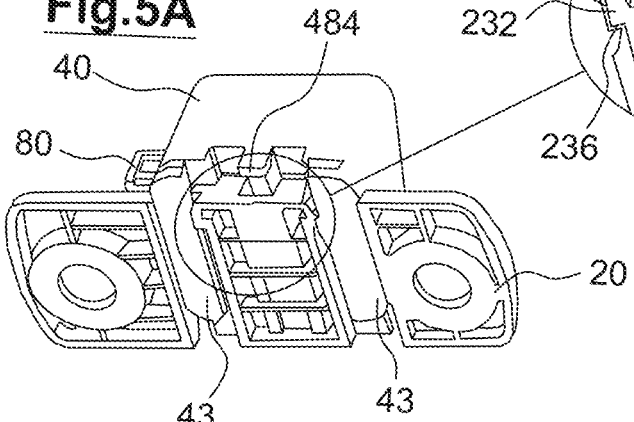
FIG. 7A represents a sectional view of a buffer with a self-adjustable stopper in the maximum deployment position according to an aspect of the disclosure.

In FIG. 7A, it is observed in the buffer with a stopper according to the disclosure, viewed from below, that the assembly of the central body 40 and the base 20 is also characterized by an elastic interlock. FIG. 7B illustrates a second blocking mechanism consisting of an element 432 on a lower wall 43 of the central body and of a second element 232 in a groove 22 of the base, these two elements being adapted to form a snap-fitting mounting. This snap-fitting makes it possible to define a second end of the path of the positioning means 482 via the blocking role thereof. Advantageously, the first 484 and the second 232, 432 blocking mechanisms delimit the path of the central body 40 on the base 20, thus rendering the disassembly of these two components 20, 40 impossible. In combination with other different devices described above, it is impossible to disassemble the buffer with a stopper according to the invention without the components being damaged. Advantageously, an operator who adjusts the buffer with a stopper in the open position is not at a risk of misplacing a constituent element.

In some aspects of the disclosure, the central body 40 can be introduced, during assembly, only via the opposite face to that comprising the stop 484.

With reference to the aspect of the disclosure in FIGS. 4B and 1C, the lower wall 43 of the central body 40 and the groove 24 of the base all have a globally increasing width along the axis Y, respectively, between D1 and D2 (D1<D2), and between L1 and L2 (L1<L2). These values are chosen such that the central body can be mounted on the base only by the cooperation of two defined faces of the central body in another face of the base. Advantageously, this arrangement makes it possible, for example, for an operator to avoid assembly errors.

Figure 8A:
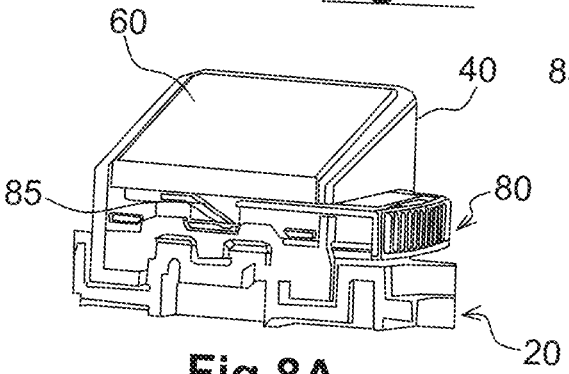
FIG. 8A represents a partial sectional view of the buffer along the section EE' in FIG. 2A.
Figure 8B:
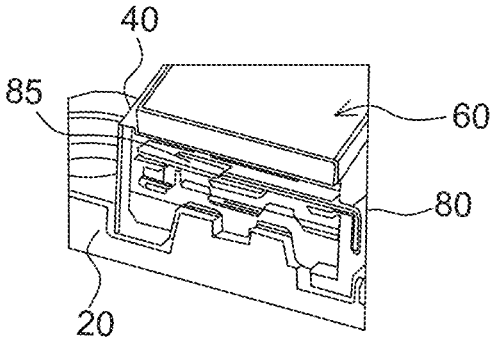
FIG. 8B represents a partial sectional view of the buffer along the section FF' in FIG. 2B.

The buffer according to the disclosure further includes means for holding the buffer head in position in the central body 40, particularly in the axis Z, even in the open position. This will be detailed hereinafter with the aid of FIGS. 8A and 8B which illustrate, respectively, a partial sectional view of the buffer in the open position along the section EE' in FIG. 2A and a partial sectional view of the buffer in the locked position along the section FF' in FIG. 2B, in the plane YZ. The locking element 80 comprises at least one rigid element 85, for example a rod. This holding element 85 is connected to the lock, for example by means of a torsion spring, such that it rests on the buffer head in order to hold it in the axis Z, in the open position as well as in the locked position. Advantageously, these means make it possible to hold the vertical position of the buffer head particularly in the open position. For example, during the routing and/or the handling of the buffer according to the invention, the lack of relative movement between components makes it possible to limit the degradation thereof The mounting of the buffer according to the disclosure on a fixed structure, while the pivoting structure is optionally equipped with a counter-stopper, is described hereinafter. The preassembled buffer with a stopper can be mounted on the fixed structure according to the following steps: (i) The buffer with a self-adjustable stopper 100 is first fastened to the chassis in a known manner, for example with standard fastening means such as screws, anti-creep rings, and washers; (ii) The second structure is rotated to adjust the central body 40 in the first direction X with respect to the base 20; (iii) The second structure is covered; (iv) The buffer head 60 is raised by depressing the locking element 80 in the central body 40 until it is in the locked position, as illustrated in FIGS. 2B and 3B, the slot 81 being located outside the central body 40; (v) The door is closed again, prestressing having then been introduced by the effect of raising the buffer head 60.

It is possible to return the buffer with a stopper to the open position by placing a tool such as a screwdriver or a dedicated tool in the slot 81 and pulling same outward until the buffer returns to the open position thereof wherein the buffer is ready to be adjusted according to steps (ii) (iii) (iv) and (v) mentioned above.

The buffer with a stopper according to the disclosure enables simple and quick mounting, and particularly reduction of the time required to perform the setting of the buffer.

What is claimed is:

1. A buffer with a self-adjustable stopper comprising a buffer head having an upper surface as a stopper, a base having a guide profile, and comprising a central body having a groove cooperating with said guide profile, the central body being mounted on the base by a translation movement, in a first direction (X) in a plane of movement, the central body at least partially receiving the buffer head by a face opposite to that in contact with the base, characterized in that the buffer head being movable relative to the central body in a third direction (Z) perpendicular to the plane of movement, and in that the buffer further comprises a locking member inserted into the central body in a second direction (Y) perpendicular to the first and third directions, and operable in translation for blocking in the third direction (Z) the buffer head in the central body and blocking in the first direction (X) the central body on the base.

2. The buffer with a self-adjustable stopper according to claim 1, characterized in that the locking member and the buffer head comprise, respectively, at least one thrust ramp and at least one housing adapted to receive said at least one thrust ramp, said at least one thrust ramp and said at least one housing being adapted, when the locking member is translationally actuated, to produce a camming effect and to allow raising of the buffer head.

3. The buffer with a self-adjustable stopper according to claim 2, characterized in that the locking member has an open position, in the central body, in which the at least one thrust ramp is received by the at least one housing and the locking member is configured to be depressed in the second direction and the locking member has a locked position, in which the buffer head is locked in the third direction.

4. The buffer with a self-adjustable stopper according to claim 3, characterized in that the locking member and the base comprise locking means which cooperate only in the locked position to lock the central body in the first direction.

5. The buffer with a self-adjustable stopper according to claim 3, characterized in that the central body is movable in the first direction, when the locking member is in the open position.

6. The buffer with a self-adjustable stopper according to claim 1, characterized in that the buffer comprises a protruding element serving as a stop for defining a path of the central body in the first direction.

7. The buffer with a self-adjustable stopper according to claim 1, characterized in that the buffer comprises means for positioning said central body on said base, when the locking member is in the open position.

8. The buffer with a self-adjustable stopper according to claim 7, characterized in that said means for positioning said central body on said base comprises a rack on the base and a belt having a bulge on the central body.

9. The buffer with a self-adjustable stopper according to claim 4, characterized in that said guide profile is T-shaped.

10. The buffer having a self-adjustable stopper according to claim 9, characterized in that said locking means comprises at least one rack on said T-shaped guide profile and at least one rack on the locking member.

11. The buffer with a self-adjustable stopper according to claim 3, characterized in that the buffer comprises a holding means for maintaining the buffer head in position in the third direction when the locking member is in the open position.

12. The buffer with a self-adjustable stopper according to claim 11, characterized in that the holding means is a rod elastically connected to the locking member and resting on the buffer head.

13. The buffer with a self-adjustable stopper according to claim 1, characterized in that the central body and the base are assembled by snap-fitting.

14. The buffer with a self-adjustable stopper according to claim 3, characterized in that the buffer comprises a slot for returning the locking member to the open position.

15. A method of mounting the buffer according to claim 3 on a first structure to separate it from a second pivoting structure, characterized in that the method comprises the following steps:

(i) fixing the self-adjustable stop buffer in the open position on the first structure;

(ii) rotating the second structure to adjust the central body in the first direction (X) relative to the base;

(iii) reopening the second structure; and (iv) locking the buffer by depressing the locking member in the second direction into the locked position.

16. A mounting method according to claim 15, characterized in that the first structure is a moveable body part of a vehicle and in that the second structure is a vehicle frame.

* * * * *